US009269214B2

(12) United States Patent
Lim et al.

(10) Patent No.: US 9,269,214 B2
(45) Date of Patent: Feb. 23, 2016

(54) HITTING GAME MACHINE ALLOWING SUCCESSIVE INPUT OF COINS

(75) Inventors: Myoung Soo Lim, Seoul (KR); Eun Joong Koo, Seoul (KR); Jong Sam Yoon, Seoul (KR); Geun Seok Heo, Koyang-si (KR)

(73) Assignee: ANDAMIRO CO., LTD., Kyonggi-Do (KR)

( * ) Notice: Subject to any disclaimer, the term of this patent is extended or adjusted under 35 U.S.C. 154(b) by 561 days.

(21) Appl. No.: 13/443,960

(22) Filed: Apr. 11, 2012

(65) Prior Publication Data

US 2012/0267850 A1 Oct. 25, 2012

(30) Foreign Application Priority Data

Apr. 22, 2011 (KR) ..... 10-2011-0037629

(51) Int. Cl.
*A63F 7/00* (2006.01)
*G07F 17/32* (2006.01)

(52) U.S. Cl.
CPC ..... *G07F 17/3202* (2013.01); *G07F 17/3216* (2013.01); *G07F 17/3297* (2013.01)

(58) Field of Classification Search
CPC ..... A63F 7/02; A63F 7/30
USPC ..... 273/126, 126 A, 127 D, 138.1–138.3
See application file for complete search history.

(56) References Cited

U.S. PATENT DOCUMENTS

| | | | | |
|---|---|---|---|---|
| 3,947,028 | A * | 3/1976 | Goldfarb et al. | 473/76 |
| 4,116,443 | A * | 9/1978 | Dorfman | 273/388 |
| 5,507,490 | A * | 4/1996 | Hagiwara | 463/16 |
| 5,707,060 | A * | 1/1998 | Ogane et al. | 273/138.2 |
| 6,206,370 | B1 * | 3/2001 | Halliburton | 273/138.1 |
| 6,991,230 | B1 * | 1/2006 | Shoemaker | 273/108 |
| 7,850,171 | B2 * | 12/2010 | Bontempo et al. | 273/142 H |
| 2011/0057385 | A1 * | 3/2011 | Lim et al. | 273/108 |

FOREIGN PATENT DOCUMENTS

| | | | | |
|---|---|---|---|---|
| KR | 20080055095 | A * | 6/2008 | A63F 9/02 |
| KR | 20080105686 | A * | 12/2008 | A63F 7/02 |

OTHER PUBLICATIONS

English translation of KR 20080055095 A, Yoon et al., Jun. 2008.*
English translation of KR 20080105686 A, Yoon et al., Dec. 2008.*

* cited by examiner

*Primary Examiner* — Melba Bumgarner
*Assistant Examiner* — Laura L Davison
(74) *Attorney, Agent, or Firm* — The PL Law Group, PLLC

(57) ABSTRACT

A hitting game machine allows the successive input of coins. In the hitting game machine, each target which is to be rotated by a hit of a hitting member includes an eccentric shaft. The target is configured such that a rotating shaft integrally rotates along with a hit surface which is to be hit by the hitting member. Further, a longitudinal section of the hit surface has a plate shape, a longitudinal section of which is in a linear shape or a shape that is reduced in width from an upper end thereof to a lower end. Therefore, it is possible for several hitting members to successively hit the same one of targets of a circular plate that is rotating.

13 Claims, 15 Drawing Sheets

PRIOR ART

PRIOR ART

PRIOR ART

HITTING GAME MACHINE ALLOWING SUCCESSIVE INPUT OF COINS

CROSS REFERENCE TO RELATED APPLICATION AND CLAIM OF PRIORITY

The present application claims the benefit of Korean patent application No. 10-2011-0037629 filed in the Korean Intellectual Property Office on Apr. 22, 2011, the entire content of which is incorporated herein by reference.

BACKGROUND

1. Field of the Invention

The present invention relates to hitting game machines.

2. Description of the Related Art

In modern times, as the standards of living are increasing, a variety of methods of enjoying leisure time have been introduced. One of the introduced methods of enjoying the leisure time is to use a game machine which is operated in such a way that a user can obtain points according to preset game rules and may receive a gift or the like or be allowed to continue the game depending on the total of obtained points.

A game machine using coins is a representative example of such game machines. The term 'game machine using coins' refers to a machine in which coins that have been input into an upper end of a main body are directly used in the game while free-falling or rotating, predetermined points are given according to preset game rules, and a gift or the like is provided or continuation of the game is allowed depending on the given points.

A representative example of such a game machine using coins was proposed in Korean Patent Application No. 10-2007-0053584 (entitled: 'Game machine using coin and coin guide used in the same). This conventional game machine is illustrated in FIG. 1.

Referring to the drawing, in the conventional game machine using coins, a plurality of target units 10 are placed upright around the circumference of a circular plate 7. An identification member is provided on each target unit 10 to identify the target unit 10. Each target unit 10 is curved at a predetermined radius of curvature and is configured such that it can rotate around an inflection point of the curved portion outwards with respect to the circular plate 7.

A coin guide unit 20 is provided on a central portion of the circular plate 7 and oriented in one direction. The coin guide unit 20 rolls a coin 5 input thereinto and guides it to try to hit down one of the target units 10 that rotate along with the circular plate 7.

Furthermore, at least one target standing unit 40 is provided at a position spaced apart from the circular plate 7 by a predetermined distance. Among the target units 10, the target standing unit 40 functions to stand up target units 10 that have been fallen by the coins 5 to their original positions.

The coin guide unit 20 is curved from the vertical direction to the horizontal direction to enable the coin 5 that has been input thereinto and which is dropped to turn in the horizontal direction and roll on the circular plate 7. The coin guide unit 20 may be curved at an appropriate radius of curvature so that the coin 5 that is dropping can easily change its direction to the horizontal direction without stopping.

Furthermore, a speed reducer 50 is provided at a predetermined position in the coin guide unit 20 so that the speed of the coin 5 that has been input into the coin guide unit 20 and being dropped can be reduced by the speed reducer 50. The speed reducer 50 includes at least one small disk 50. The small disk 50 is mounted to a predetermined portion of the coin guide unit 20 so as to be rotatable around a point on the circumference thereof.

However, in the conventional hitting game machine having the above-mentioned construction, the coin guide must use the separate speed reducer, reducing the speed of the coin that is dropping.

It is difficult to manufacture such a speed reducer because it has a plurality of stop protrusions. Deviation of the manufacturing work makes the speed at which a coin drops different in each game machine.

FIGS. 2 and 3 illustrate an enlargement of a target unit which is coupled to the circular plate of the conventional hitting game machine.

In detail, FIG. 2 is an enlarged view showing the target unit coupled to the circular plate of the conventional hitting game machine. FIG. 3 is a reference view illustrating the operation of rotating the target unit of FIG. 2. FIG. 4 is a reference view illustrating a process in which a rotating shaft 14*c* of the target unit 10 of FIG. 2 is rotated by a hitting member. Each target unit 10 includes a hinge bracket 12 and a target 14. The hinge bracket 12 includes a coupling part 12*a* which is coupled to the circumferential outer edge of the circular plate 7, an identification-member attaching part 12*c* to which an identification member is attached, a target support 12*d*, a target stopper 12*f* and a hinge coupling depression 12*e*. The target 14 includes a rotating shaft 14*c* which includes a cam-shaped hinge, a hit-part support 14*a* and a hit part 14*b*.

The rotating shaft 14*c* is coupled to the hinge coupling depression 12*e*. The hit-part support 14*a* is supported on the circular plate 7 to allow the hit part 14*b* to lean towards the center of the circular plate 7 so that when the target 14 rotates along with the circular plate 7, the target 14 can be prevented from undesirably falling over due to the centrifugal force or by receiving impacts unrelated to the game.

However, in the target unit having the above-mentioned construction, as shown in FIG. 3, if while the target 14 has been rotating by Coin 1 that has hit the hit part 14*b*, Coin 2 which is another coin successively rolls to the target 14, Coin 2 collides with the hit-part support 14*a* that is rotating. Thereby, Coin 2 may be placed on the circular plate rather than entering the hitting member receiver, thus blocking a path of another coin that is rolling on the circular plate, or if coins are placed under the hit-part support 14*a*, they may impede the function of the target standing unit 40, making the game no longer able to be played.

Furthermore, the rotating shaft 14*c* of the target 14 is disposed under the medial portion of the target. Therefore, if the width of the target is comparatively small, the target that has fallen over may undesirably return to its standing-up position.

Moreover, the rotating shaft 14*c* of the target 14 is inserted into the circular hinge coupling depression 12*e* without use of a separate fastening member, and the thickness of the rotating shaft 14*c* is almost equal to the depth of the hinge coupling depression 12*e*. Therefore, if the width of the hit part 14*b* is less than that of the rotating shaft 14*c*, not only the target may undesirably bounce up due to impact or vibrations but also a coin that passes over the rotating shaft 14*c* affects the rotating shaft 14*c*, thus making the target move as if it had actually been hit despite there having been no hit.

In other words, as shown in FIG. 4, despite a coin passing by the target without hitting the target, if the coin touches the rotating shaft, the target may rotate as if it had been hit by the coin.

SUMMARY

Accordingly, the present invention has been made keeping in mind the above problems occurring in the prior art, and a first object of the present invention is to provide a hitting game machine which allows coins to be successively input thereinto.

A second object of the present invention is to provide a hitting game machine in which, to allow coins to be successively input thereinto, a longitudinal section of a hit surface has a linear shape or a shape that is reduced in width from the upper end thereof to the lower end.

A third object of the present invention is to provide a hitting game machine which is configured such that when a target rotates around an eccentric shaft, the speed at which it rotates can be reduced.

A fourth object of the present invention is to provide a hitting game machine in which a hollow space is formed in the rotating shaft, thus reducing the weight of the rotating shaft.

A fifth object of the present invention is to provide a hitting game machine which does not require a separate speed reducer in a coin guide.

In order to accomplish the first and second objects, the present invention provides a hitting game machine allowing successive input of coins, the hitting game machine being operated in such a way as to sense a target rotated by a hit of a hitting member and to process a game, the target including a rotating shaft provided with an eccentric shaft formed at a position eccentric from a center of the rotating shaft, the rotating shaft rotating on the eccentric shaft, and a hit surface to be hit by the hitting member, the hit surface integrally rotating with the rotating shaft and having a plate shape, a longitudinal section of which is a linear shape or a shape that is reduced in width from an upper end thereof to a lower end.

In order to accomplish the third object, in the hitting game machine allowing successive input of coins according to the present invention, a protrusion may be provided on the surface of the eccentric shaft so that when the rotating shaft rotates, the protrusion selectively makes contact therewith and generates a frictional force depending on an angle at which the rotating shaft rotates.

In order to accomplish the fourth object, in the hitting game machine allowing successive input of coins according to the present invention, the eccentric shaft may include eccentric shafts provided on respective opposite ends of the rotating shaft, and a hollow space having a predetermined length may be formed in each of the opposite ends of the rotating shaft at a position other than the eccentric shaft.

In order to accomplish the first object, the hitting game machine may further include a circular plate to which at least one target is coupled, the circular plate being partitioned into at least one region and being operated by a drive unit, wherein the target is coupled to the circular plate such that even when the target coupled to the circular plate is being rotated or has been rotated by a hit of a hitting member, another subsequent hitting member is allowed to pass over the same target.

The hitting game machine may further include a hinge bracket to which the rotating shaft of the target is rotatably coupled, and at least one coupler provided on the circular plate so that the hinge bracket is coupled to the circular plate by the coupler. The hinge bracket may include a base plate, a first over-rotation-preventing stopper provided on the base plate, a hinge coupling depression formed on the base plate at a position spaced apart from the first over-rotation-preventing stopper by a predetermined distance so that the eccentric shaft of the target is inserted into and supported in the hinge coupling depression, a second over-rotation-preventing stopper provided on the base plate at a position adjacent to the hinge coupling depression, the second over-rotation-preventing stopper being disposed at a position lower than the first over-rotation-preventing stopper.

The hitting member guide may curve from a vertical direction to a horizontal direction to allow the hitting member that has been inserted and is dropped to turn in the horizontal direction and roll on the circular plate towards the target. The hitting member guide may further include a speed reducer reducing a speed at which the hitting member that has been input is dropping, the speed reducer including: a disk installed in the hitting member guide so as to be rotatable around a point on a circumference thereof or a center axis thereof, and a cylindrical stop protrusion provided at a predetermined position on the disk to prevent the disk from rotating beyond a predetermined angle.

In order to accomplish the fifth object, the hitting member guide may have a linear shape that allows the hitting member that has been input into the hitting-member insert port to move towards the target, wherein a bottom surface of the hitting member guide along which the hitting member rolls is wavy or uneven so that a speed at which the hitting member moves downwards is reduced.

In order to accomplish the fifth object, the hitting member guide may be curved from a vertical guide part to a horizontal guide part so that the hitting member that has been input into the hitting-member insert port and has been dropping turns in a direction toward the target and rolls on the circular plate, wherein the vertical guide part has an S shape.

In order to accomplish the sixth object, the target may be configured such that a lower end of the hit surface connected to the rotating shaft has a predetermined height and width.

The hitting game machine may further include a control unit providing a jackpot or a bonus game when a preset one of the at least one target has fallen over a predetermined number of times or more.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION

The terms and words used in the specification and claims are not necessarily limited to typical or dictionary meanings, but must be understood to indicate concepts selected by the inventor as the best method of illustrating the present invention, and must be interpreted as having meanings and concepts adapted to the scope and spirit of the present invention for understanding the technology of the present invention.

In the specification, when the explanatory phrase "a part includes a component" is used, this means that the part may further include the component without excluding other components, so long as special explanation is not given. Furthermore, the terms, such as ". . . part", ". . . unit", "module", "device", etc., indicate a unit for processing at least one function or operation, and it can be embodied by hardware, software or a combination of hardware and software.

Hereinafter, an embodiment of the present invention will be described in detail with reference to the attached drawings.

Figure 1:
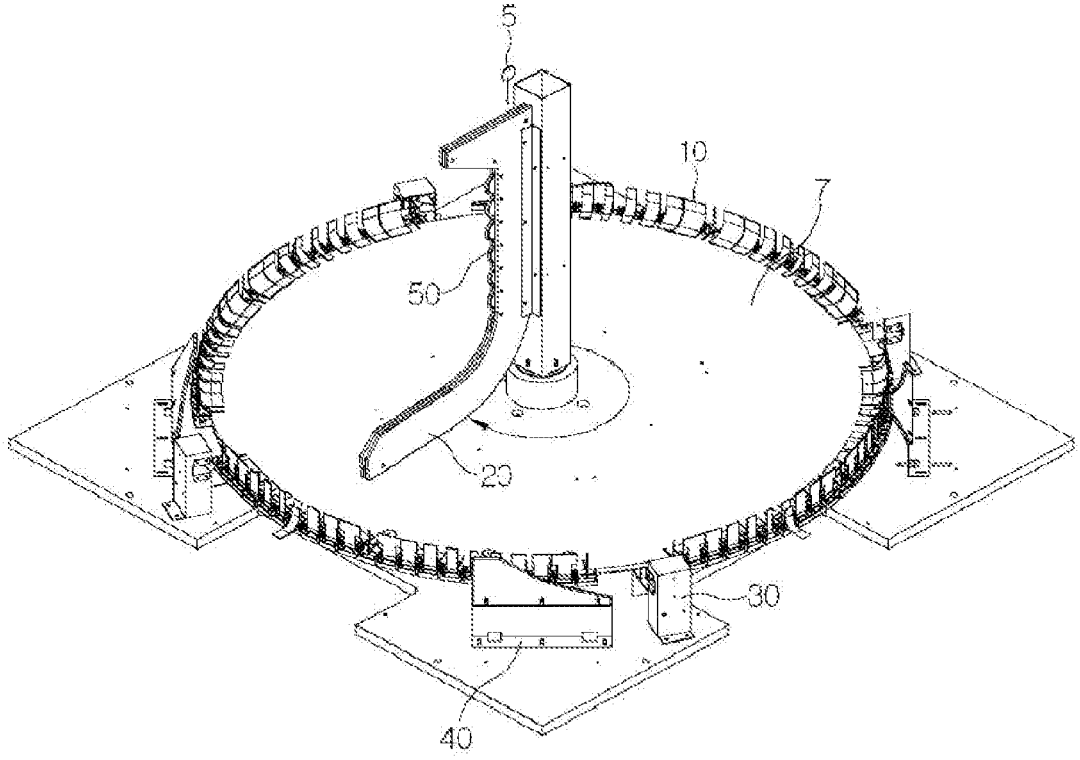
FIG. 1 is a view showing a conventional hitting game machine.
Figure 2:
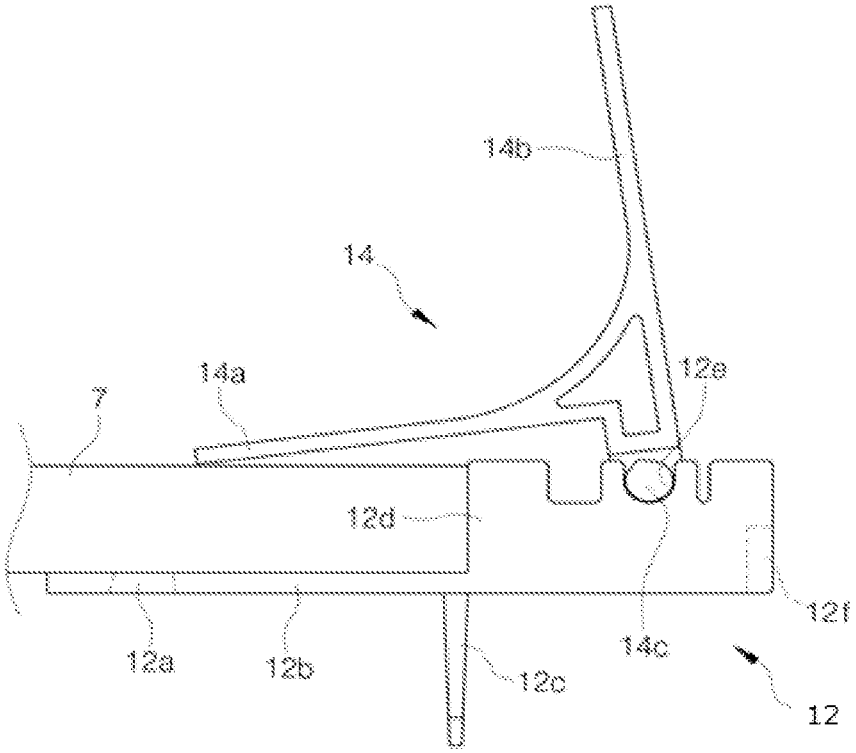
FIG. 2 is an enlarged view showing a target unit which is to be coupled to a circular plate of the conventional hitting game machine.
Figure 3:
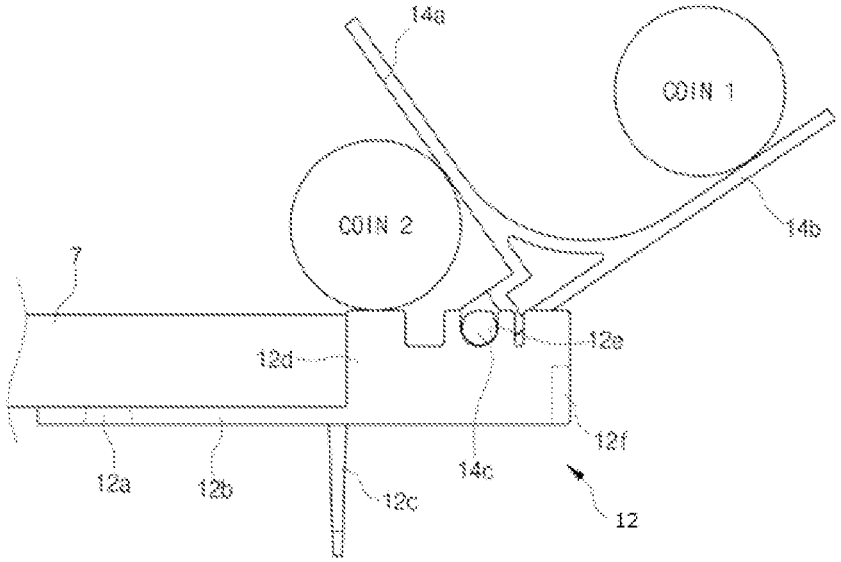
PRIOR ART FIG. 3
FIG. 3 is a reference view illustrating the operation of rotating the target unit of FIG. 2.
Figure 4:
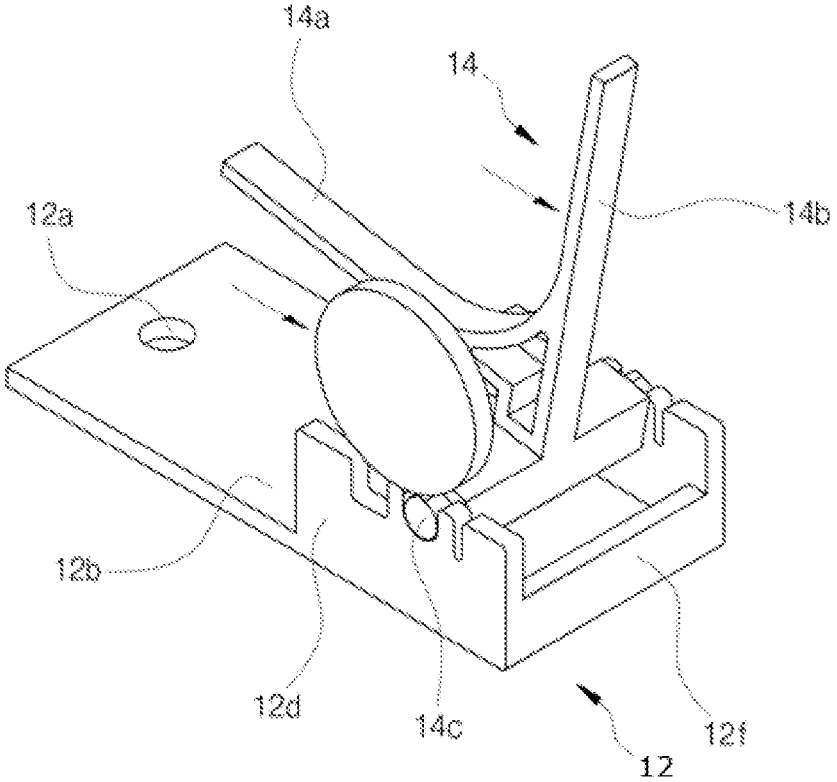
FIG. 4 is a reference view illustrating a process in which a rotating shaft of target unit of FIG. 2 is rotated by a coin.
Figure 5:
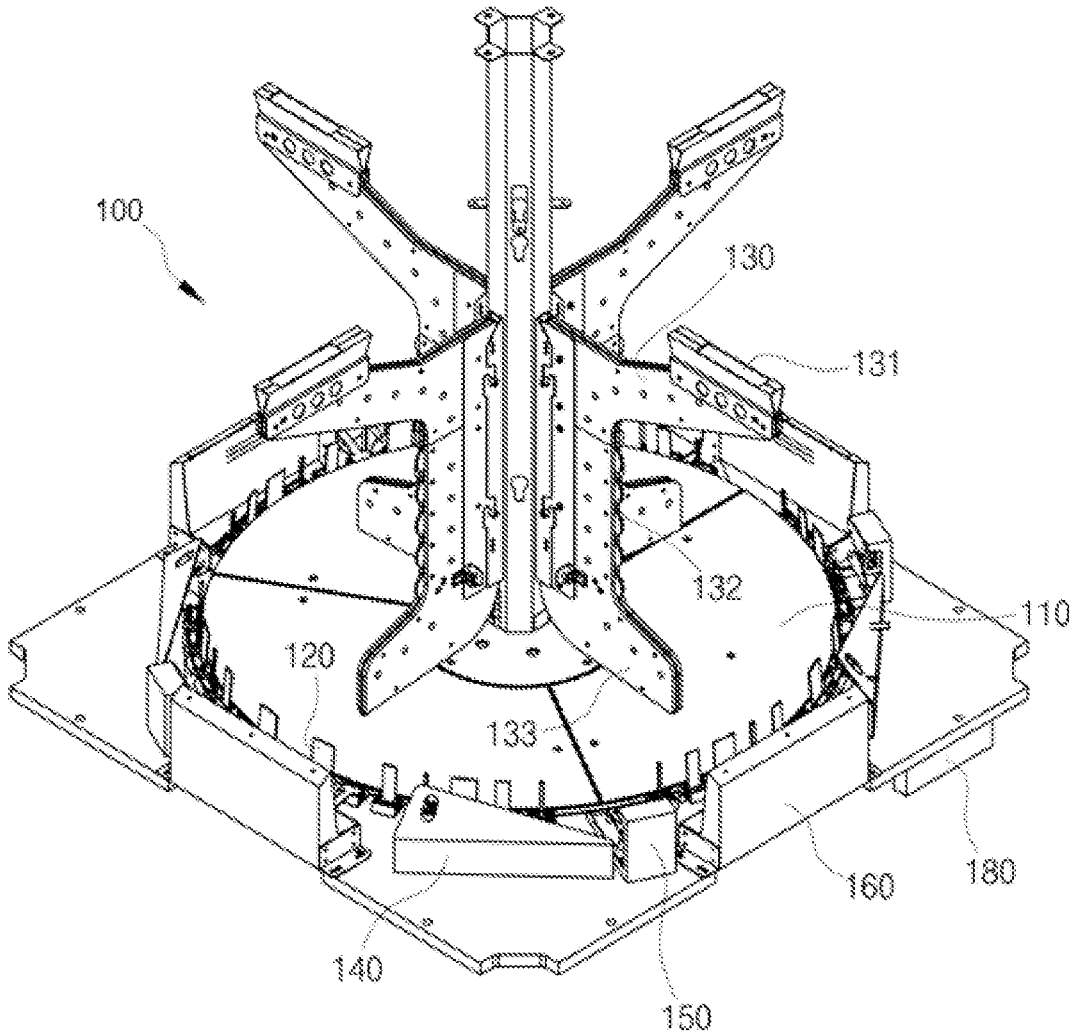
FIG. 5 is a perspective view of a hitting game machine allowing the successive input of coins, according to an embodiment of the present invention.

FIG. 5 is a perspective view of a hitting game machine allowing the successive input of coins, according to an embodiment of the present invention. As shown in FIG. 5, the hitting game machine 100 according to the embodiment of the present invention includes a circular plate 110, a plurality of target units 120, hitting member guides 130, target standing units 140, target sensing units 150, hitting member receivers 160 and a control unit 180.

The circular plate 110 is partitioned into one or more regions and is provided so as to be rotatable. The target units 120 are coupled by screws to respective couplers (not shown), which are provided on a circumferential outer edge of the circular plate 110. The target units 120 are provided on the circumferential outer edge of each of the regions of the circular plate 110. Furthermore, an identification member is provided under each target unit 120.

Each region of the circular plate 110 is partitioned into a plurality of sections, each of which has a fan shape that has the center of the circular plate 110 as its center and includes the corresponding target unit 120. A light source is electrically connected to a rear surface of each section of the circular plate 110 so that each section can flash on and off.

Figure 11:
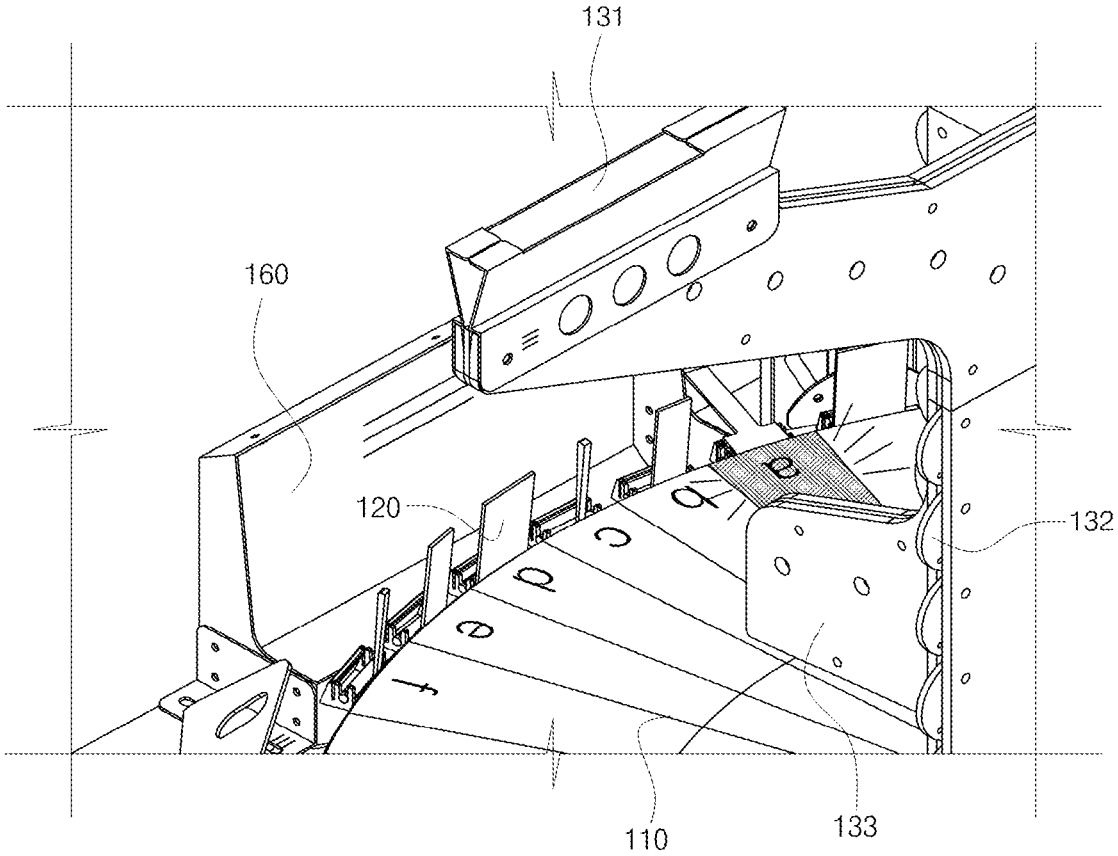
FIG. 11 is a view illustrating a visual effect for a hit target.

Referring to FIG. 11 illustrating a visual effect for indicating that a target unit 120 has been hit, when a hitting member 170 that has rolled out of the hitting member passing channel 133 hits the target unit 120 and enters the corresponding hitting member receiver 160, the corresponding light source is operated so that the corresponding section (in the drawing, designated by "a") of the circular plate 110 that pertains to the hit target unit 120 flashes on and off.

Each target unit 120 includes a hinge bracket 122 and a target 124. The hinge bracket 122 is fastened to the circular plate 110. The target 124 is hinged to the hinge bracket 122 so that when a hitting member 170 hits the target 124, the target 124 rotates outwards with respect to the circular plate 110. As stated above, the target units 120 are provided on the circumferential edges of the respective sections of the circular plate 110, and each target unit 120 has the identification member under the lower end thereof.

Figure 10:
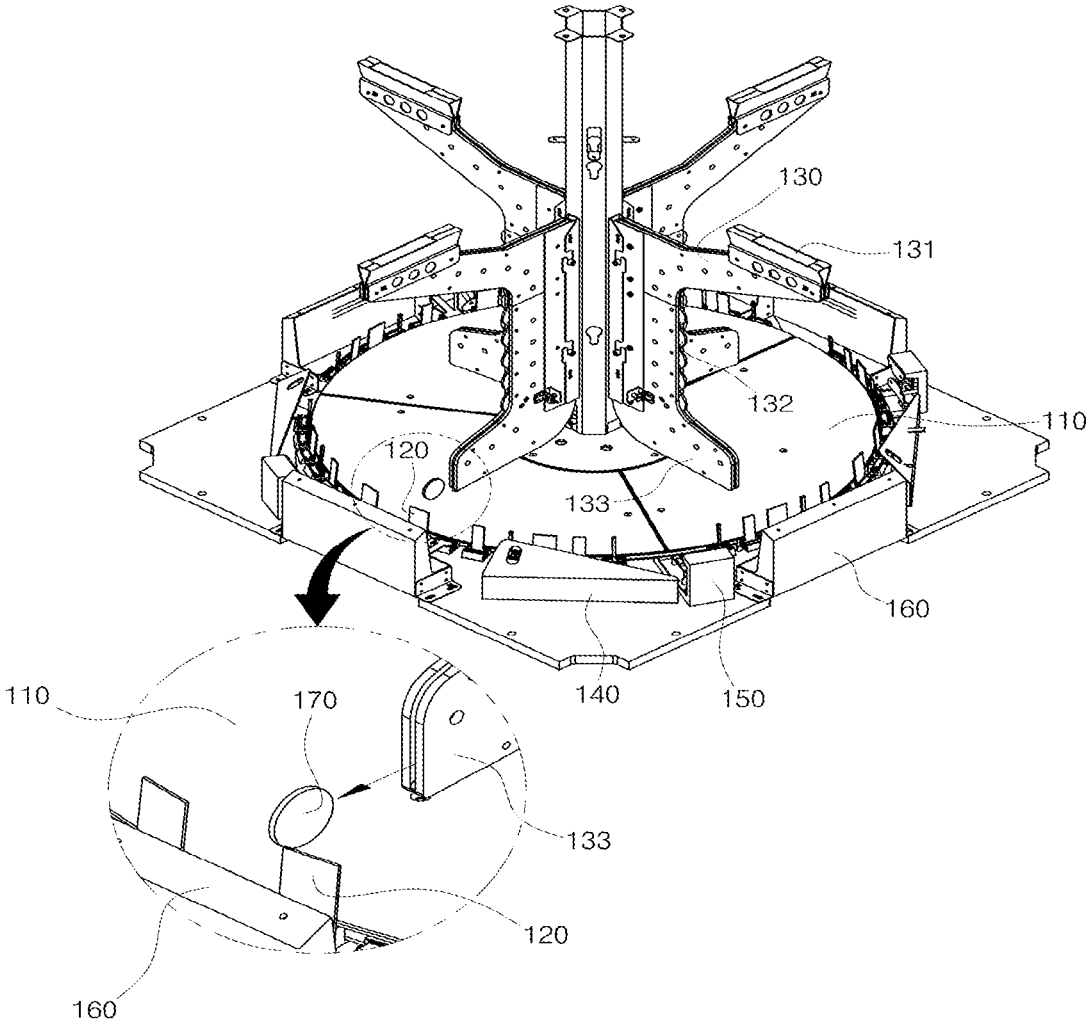
FIG. 10 is a view illustrating the operation in which a hitting member hits a target.

FIG. 10 is a view illustrating the operation in which a hitting member hits a target 124. A hitting member 170 rolls out of the hitting member guide 130 to hit a target 124 and then enters the hitting member receiver 160.

The construction of the target unit 120 will now be explained in detail with reference to FIGS. 13 through 18.

Figure 13:
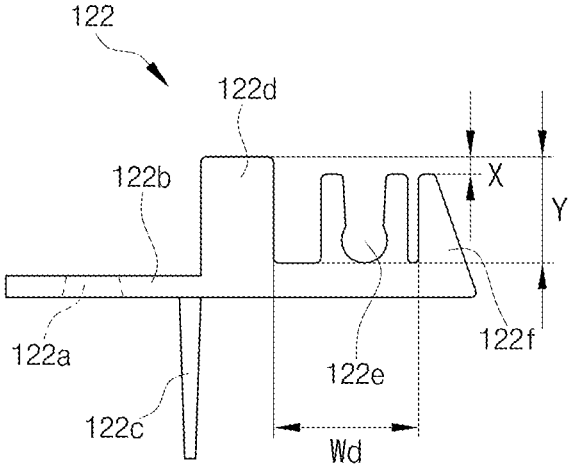
FIG. 13 is a longitudinal sectional view showing an enlargement of a hinge bracket of a target unit.
Figure 14:
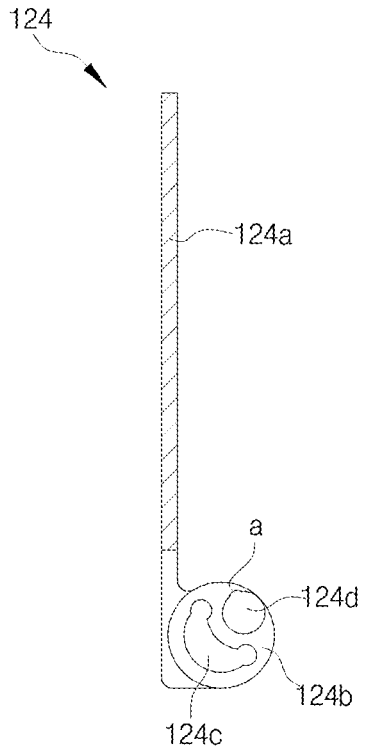
FIG. 14 is a longitudinal sectional view showing an enlargement of a target which is coupled to the hinge bracket of FIG. 13.
Figure 15:
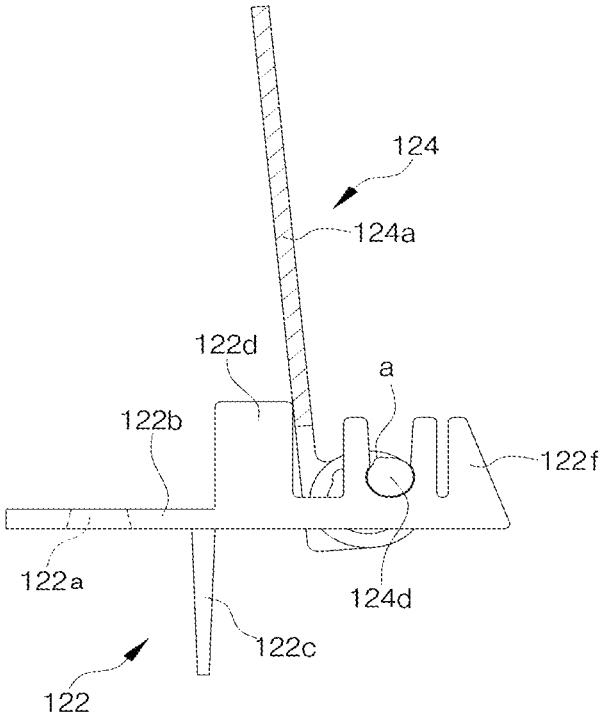
FIG. 15 is a longitudinal sectional view showing the target of FIG. 14 that is coupled to the hinge bracket.
Figure 17:
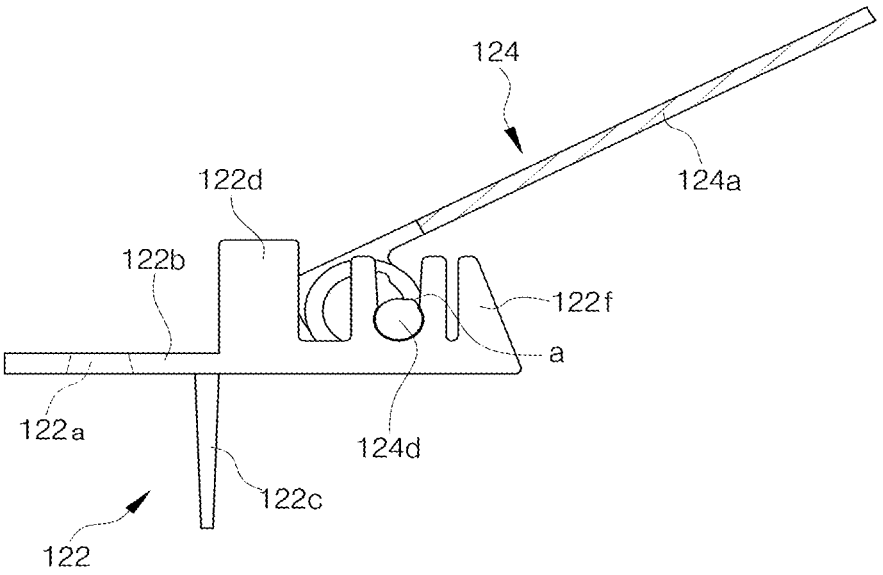
FIG. 17 is a reference view illustrating the rotation of the target hit by a hitting member.
Figure 18:
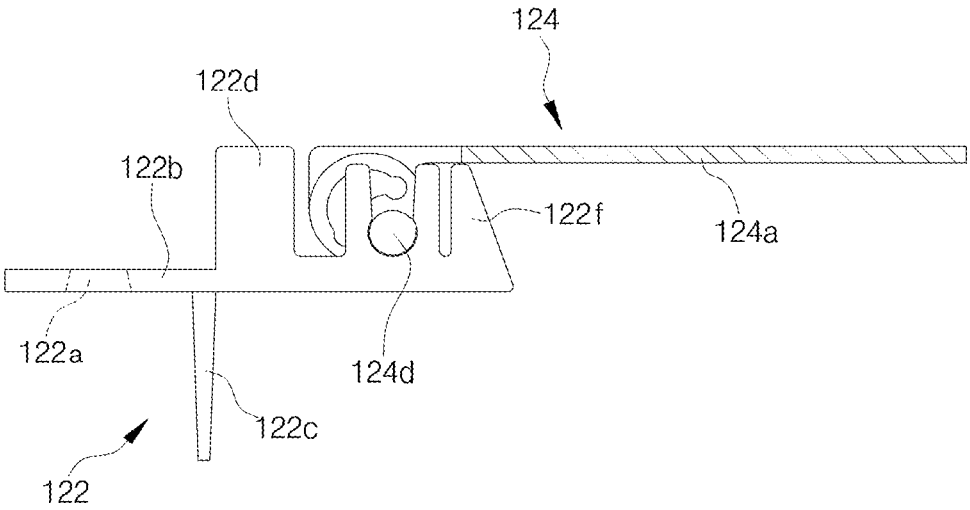
FIG. 18 is a longitudinal sectional view showing the target that has been hit and completely rotated downwards.

FIG. 13 is a longitudinal sectional view showing an enlargement of the hinge bracket 122 of the target unit 120. FIG. 14 is a longitudinal sectional view showing an enlargement of the target 124 which is coupled to the hinge bracket 122. FIG. 15 is a longitudinal sectional view showing the target 124 that is coupled to the hinge bracket 122. FIG. 17 is a reference view illustrating the rotation of the target 124 hit by a hitting member 170. FIG. 18 is a longitudinal sectional view showing the target 124 that has been hit and completely rotated downwards. The hinge bracket 122 is coupled to the corresponding coupler which is provided on the circumferential outer edge of the circular plate 110, and a rotating shaft 124*b* of the target 124 is coupled to the hinge bracket 122 so that the target 124 can rotate with respect to the hinge bracket 122.

Each target unit 120 includes the hinge bracket 122 and the target 124. The hinge bracket 122 includes a coupling part 122*a* which is coupled to the circumferential outer edge of the circular pate 110, an identification member attaching part 122*c* to which the identification member is attached, a first over-rotation-preventing stopper 122*d*, a second over-rotation-preventing stopper 122*f* and a hinge coupling depression 122*e*. The target 124 includes a hit surface 124*a* and a rotating shaft 12*b*.

In detail, referring to FIGS. 13 showing an enlargement of the hinge bracket 122, the hinge bracket 122 includes a base plate 122*b*, the first over-rotation-preventing stopper 122*d* which is provided on an upper surface of the base plate 122*b*, the hinge coupling depression 122*e* which is formed on the upper surface of the base plate 122*b* at a position spaced apart from the first over-rotation-preventing stopper 122*d* by a predetermined distance so that an eccentric shaft 124*d* of the target 124 is inserted into the hinge coupling depression 122*e*, and the second over-rotation-preventing stopper 122*f* which is provided on the upper surface of the base plate 122*b* at a position adjacent to the hinge coupling depression 122*e*.

The hinge bracket 122 having the above-mentioned construction is coupled to the coupler (not shown) of the circular plate 110 such that even when the target 124 that is coupled to the hinge bracket 122 is being rotated or has been rotated by a hitting member 170, another subsequent hitting member 170 is allowed to pass through the same target 124.

Adjusting the relative heights of the first over-rotation-preventing stopper 122*d* and the second over-rotation-preventing stopper 122*f* can make it smoother for successive hitting members 170 to hit the target 124 and pass through it. For instance, if the height of the second over-rotation-preventing stopper 122*f* is less than that of the first over-rotation-preventing stopper 122*d*, the hitting members 170 can easily enter the hitting member receiver 160.

Furthermore, the hinge coupling depression 122*e* is formed to a depth Y such that the rotating shaft 124*b* is disposed at a sufficiently low position to allow the hitting members 170 that are rolling to pass over the rotating shaft 124*b* without touching it The shape of the hinge coupling depression 122*e* corresponds to that of a hinge so that the rotating shaft 124*b* can be inserted and reliably supported in the hinge coupling depression 122*e*, thus preventing even a small impact or vibration from easily causing the target 124 to fall over.

That is, referring to FIG. 13, because the second over-rotation-preventing stopper 122*f* is designed to be lower than the first over-rotation-preventing stopper 122*d* by a distance "X", a hitting member 170 that has hit the target 124 can more easily pass over the first over-rotation-preventing stopper 122*d*.

Furthermore, the hinge coupling depression 122*e* is formed to a position deeper than the diameter of the rotating shaft 124*b*, thereby preventing a rolling surface of the hitting member 170 from touching the rotating shaft 124*b* and causing the target 124 to fall over when the hitting member 170 is passing by the target 124.

In addition, a width Wd between the first over-rotation-preventing stopper 122*d* and the second over-rotation-preventing stopper 122*f* is determined such that the rolling surface of the hitting member 170 is prevented from touching any portion of the rotating shaft 124*b* when the hitting member 170 passes over the first and second over-rotation-preventing stoppers 122*d* and 122*f*.

Figure 16:
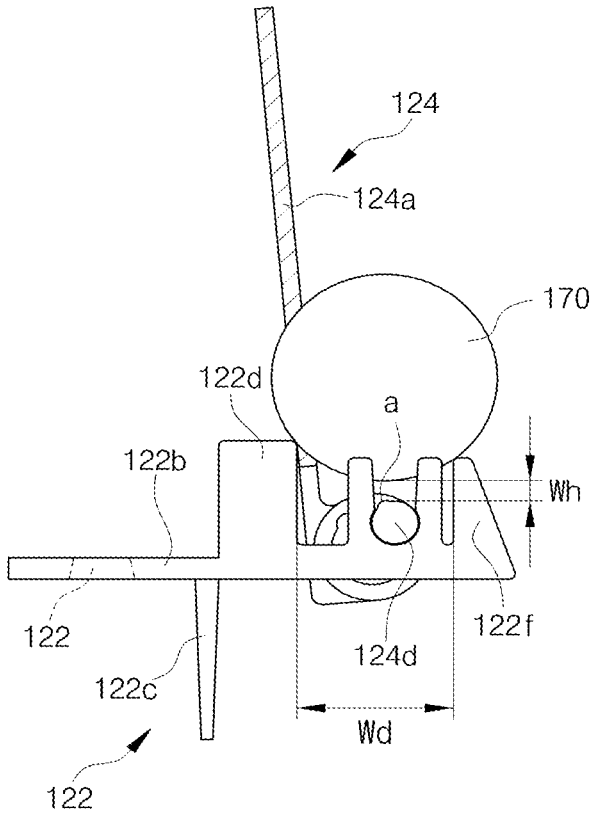
FIG. 16 is a reference view illustrating the dynamics between the hinge bracket and the target.

FIG. 16 is a reference view illustrating the dynamics between the hinge bracket and the target. Referring to the drawing, the width Wd between the first over-rotation-preventing stopper 122*d* and the second over-rotation-preventing stopper 122*f* is set such that when the rolling surface of the hitting member 170 comes into contact with both the first and second over-rotation-preventing stoppers 122*d* and 122*f*, no portion of the rolling surface of the hitting member 170 makes contact with the rotating shaft 124*b*.

That is, there is at least a space Wh defined between the lower portion of the rolling surface of the hitting member 170 and the upper surface of the rotating shaft 124*b* so that the lower portion of the rolling surface of the hitting member 170 does not come into contact with the upper surface of the rotating shaft 124*b* under any circumstances.

A coupler such as a screw is used to couple the coupling part 122*a* of the hinge bracket 122 to the circumferential outer edge of the circular plate 110. An identification member is attached to the identification-member attaching part 122*c* to allow the target sensing unit 150 to identify the corresponding target 124 using the identification member.

In other words, the identification member stores positional information of the corresponding target 124 to allow the target sensing unit 150 to detect which target 124 has been fallen and which region the target 124 is in.

The first over-rotation-preventing stopper 122*d* functions to support the hit surface 124*a* of the target 124 to allow the target 124 to lean towards the center of the circular plate 110 so that when the circular plate 110 rotates, the target 124 coupled to the hinge bracket 122 can be prevented from undesirably being fallen by the centrifugal force or vibrations unrelated to the game. The second over-rotation-preventing stopper 122*f* functions to prevent the target 124, which has been hit by a hitting member 170 and fallen over, from excessively rotating.

For this, the longitudinal sectional shape of the hit surface is linear. Here, the term 'longitudinal section' is a term that is determined based on the hit surface, to which a hitting member hits, designating the oblique line portions of FIGS. 14 through 18.

The hinge coupling depression 122*e* is coupled to the eccentric shaft 124*d* of the target 124 so that the target 124 can be reliably coupled to the hinge bracket 122. Furthermore, the eccentric shaft 124*d* and the hinge coupling depression 122*e* are configured such that when the target 124 leans to a predetermined angle, frictional force is generated therebetween, thus reducing the force with which the target 124 rotates.

To achieve the above purpose, a protrusion "a" is provided on the eccentric shaft 124*d* of the target 124 (refer to FIG. 14). Thus, when the eccentric shaft 124*d* that is coupled to the hinge coupling depression 122*e* rotates to the predetermined angle, the protrusion "a" comes into contact with a side surface of the hinge coupling depression 122*e*, thus generating friction therebetween, thereby reducing the force with which the target 124 rotates.

The eccentric shafts 124*d* having the above-mentioned structure are provided on the respective opposite ends of the rotating shaft 124*b*. A hollow space 124*c* of a predetermined length is formed in each of the opposite ends of the rotating shaft 124*b* at a position other than the eccentric shaft 124*d*, thus reducing the weight of a lower end of the target 124.

Referring to FIG. 14, the hollow space 124*c* is formed in a portion of the rotating shaft 124*b* other than the eccentric shaft 124*d*.

The reason for this shape of the target 124 is to prevent a fine impact or vibrations that do not pertain to a normal hit from causing the target 124 to fall over and to prevent the target 124 that has fallen over from undesirably returning, particularly, in the case of a narrow target 124.

Referring to FIG. 15, the hit surface 124*a* of each target 124 is a portion that is hit by a member 170 and is supported by the first over-rotation-preventing stopper 122*d* such that the target 124 leans towards the center of the circular plate 110 to prevent the target 124 from falling over due to the centrifugal force generated when the target unit 120 rotates along with the circular plate 110.

Furthermore, the target units 120 are configured such that the heights of the targets 124 are the same but their widths are different from each other. Depending on the width of each target 124, a corresponding one of different points, gifts, tickets and medals is set for the target units 120, and as a target 124 is hit, the corresponding item is indicated.

Figure 20:
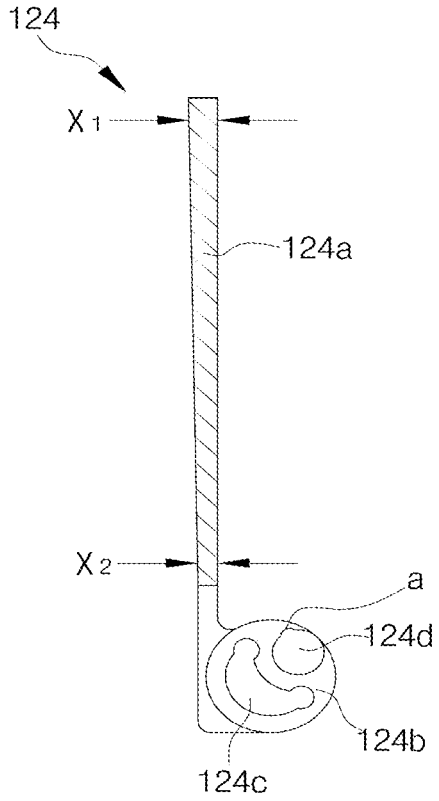
FIGS. 20 through 22 are views showing other types of targets.

In this embodiment, although the longitudinal sectional shape of the hit surface 120 has been illustrated as being linear, the longitudinal section of the hit surface 120 that is in the stand-up state may have a shape that is reduced in thickness from the upper end thereof to the lower end, as shown in FIG. 20, showing the shape of another example of the target 124.

In other words, a width $X_2$ of the lower end of the longitudinal section of the hit surface 120 that is adjacent to the rotating shaft is less than a width $X_1$ of the upper end thereof.

In this case, the center of gravity of the hit surface is located at a comparatively high position. Therefore, after the target 124 has rotated downwards, the target 124 can be more effectively prevented from undesirably returning due to the repulsive force generated when the target 124 rotates downwards.

Figure 21A:
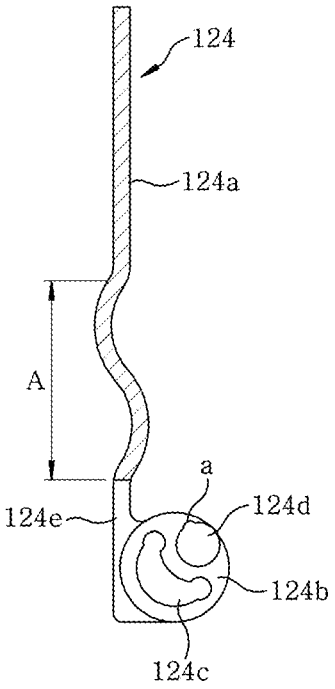
Figure 21B:
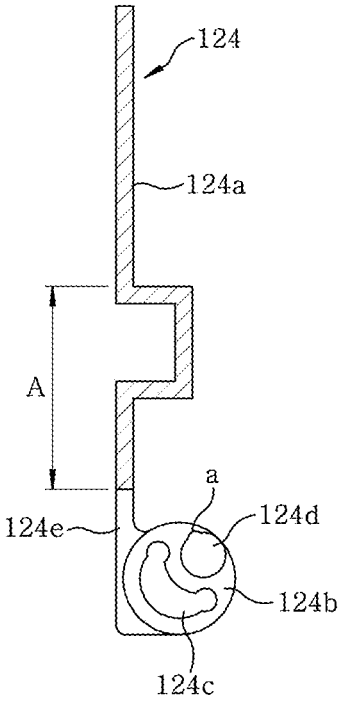
Figure 21C:
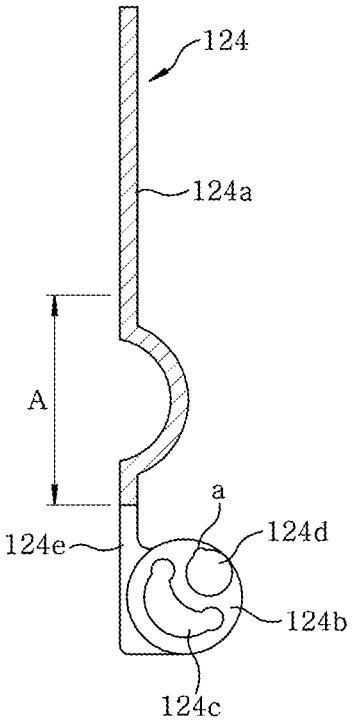
Figure 22:
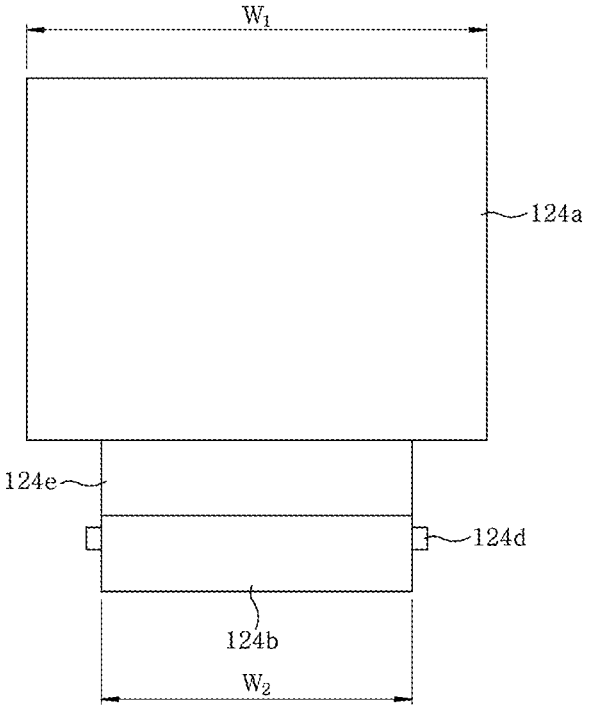

As shown in FIGS. 21 through 22 showing other examples of the shape of the target, the shape between the hit surface 124*a* and a rolling plate 124*e* of the target 124 can be modified into a variety of shapes.

Referring to FIGS. 21A through 21C, the shape of a longitudinal section (A) of a portion between the hit surface 124*a* and the rolling plate 124*e* may be an S shape (FIG. 21A), a stepped shape (FIG. 21B), or a semicircular shape (FIG. 21C). Furthermore, referring to FIG. 22, a width W1 of the hit surface 124*a* may be greater than a width W2 of the rolling plate 124*e*.

The embodiment of the present invention is technically characterized both by the rotating shaft having the eccentric shaft 124*d* and the hollow space 124*c* and by the plate-shaped hit surface 124*a*, but the shape of the hit surface is not limited to a special shape.

The process in which the target 124 is hit and rotated downwards will be explained. First, as shown in FIG. 15, the eccentric shaft 124*d* of each target 124 is inserted into and supported in the hinge coupling depression 122*e* formed on the upper surface of the base plate 122*b* of the corresponding hinge bracket 122 such that the hit surface 124*a* is supported by the first over-rotation-preventing stopper 122*d*. The circular plate 110 subsequently rotates.

The characteristic structure of the rotating shaft 124*b* having the eccentric shaft 124*d* and the hollow space 124*c* makes the target 124 stay in the state of being stably coupled despite the rotation of the circular plate or fine vibrations.

Thereafter, if a hitting member 170 is input and then hits the hit surface 124*a* of the target 124 after passing through the hitting member guide 130, the hit surface 124*a* that has been hit is rotated around the eccentric shaft 124*d* outwards from the circular plate 110, as shown in FIG. 17.

During the rotation of the target 124, the protrusion "a" of the eccentric shaft 124*d* comes into contact with the side surface of the hinge coupling depression 122*e*, thus offsetting some of the rotating force of the target 124. Subsequently, when the target 124 has completely rotated, as shown in FIG. 18, the hit surface 124*a* is supported by the second over-rotation-preventing stopper 122*f*.

Here, when the target 124 that has been rotating collides with the second over-rotation-preventing stopper 122*f*, even if the target 124 bounces off the second over-rotation-preventing stopper 122*f*,the rotating shaft 124*b* having the eccentric shaft 124*d* and the hollow space 124*c* and the protrusion "a" formed on the eccentric shaft 124*d* offset the repulsive force, thus preventing the target 124 from being returned to its original position.

In the embodiment of the present invention that is operated in the above-mentioned manner, even when the target 124 is rotating or has completely rotated, several hitting members 170 can successively hit the same target 124 or pass over it.

That is, the present invention is characterized in that the target unit 120 is coupled to the circular plate 110 such that even when the target 124 of the target unit 120 coupled to the circular plate 110 is being rotated by a hit of a hitting member 170 or has been rotated, another successive hitting member is allowed to go towards or pass over the target unit 120.

One example of such a configuration for realizing the above purpose is a configuration made such that the hit surface 124*a* that has been completely rotated downwards is lower than the upper surface of the circular plate 110.

In other words, as stated above, the height of the second over-rotation-preventing stopper 122*f* is set such that it is lower than that of the first over-rotation-preventing stopper 122*d* by the distance "X" so that the height of the first over-rotation-preventing stopper 122*d* is equal to or higher than that of the hit surface 124*a* after the hit surface 124*a* has been hit and completely rotated downwards.

However, the present invention is not limited to the configuration in which the height of the second over-rotation-preventing stopper 122*f* is set such that it is lower than that of the first over-rotation-preventing stopper 122*d* by the distance "X".

The reason for this is because the above-mentioned height difference cannot be an issue due to several factors, such as a rotating speed of the rolling hitting member that results from the shape or height of the hitting member guide 130, a rotating speed of the circular plate, the weight of the hitting member, etc.

Figure 19:
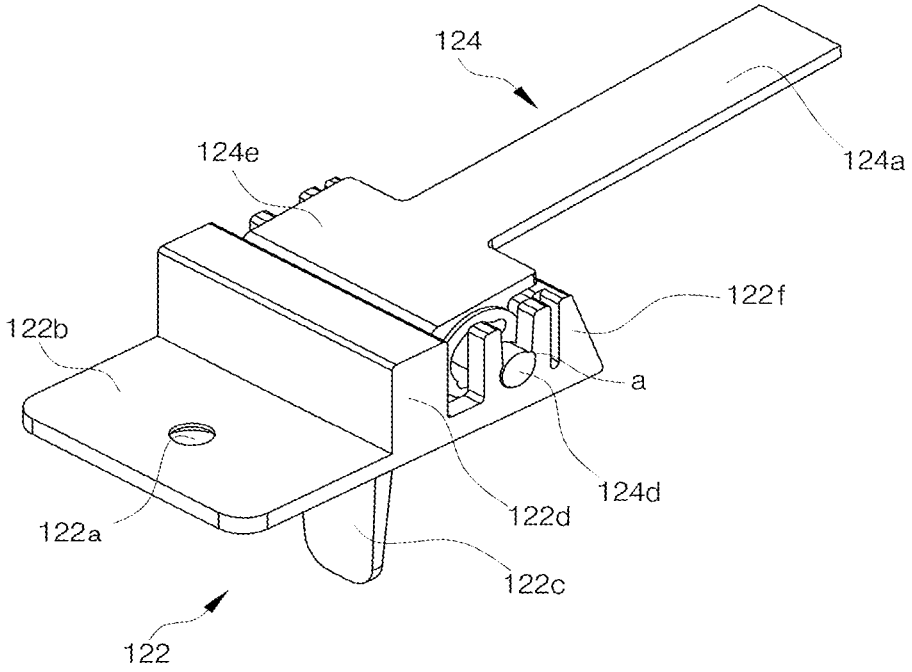
FIG. 19 is a perspective view of FIG. 18.

In other words, as shown in FIG. 19, even if the height of the hit surface 124*a* that has completely rotated downwards is equal to or higher than that of the first over-rotation-preventing stopper 122*d*, changing the shape or height of the hitting member guide 130 or the shape or weight of the hitting member 170 can allow several successive hitting members 170 to move towards the same target 124 and pass over it.

Moreover, the width of the rolling plate 124*e* (refer to FIG. 19), which has a predetermined height and is coupled to the lower end of the hit surface 124*a* to connect it to the rotating shaft 124*b* of the target 124, is the same as that of the rotating shaft 124*b*. Hence, even when a target 124 that has been hit by a hitting member 170 is being rotated or has been rotated, the hitting member 170 can more easily roll on the rolling plate 124*e* and pass over the target unit 120 without being impeded by the over-rotation-preventing stopper or the hinge bracket 122.

Each hitting member guide 130 is installed on a central portion of the corresponding region of the circular plate 110 and oriented in one direction. A hitting member insert port is provided on one end of the hitting member guide 130. The hitting member guide 130 guides a hitting member 170 input into the hitting-member insert port to move towards the target 124 and try to hit one of the targets 124.

Referring to FIG. 5, in this embodiment, the circular plate 110 is partitioned into four regions, and the hitting member guide 130 includes four hitting member guides 130, thus allowing four persons to enjoy the game at the same time.

Furthermore, because a hitting member 170 that has come out of the hitting member guide 130 moves towards the targets 124 in unlimited patterns, the number of hitting member guides 130 may be less than or equal to the number of regions of the circular plate 110.

Figure 6:
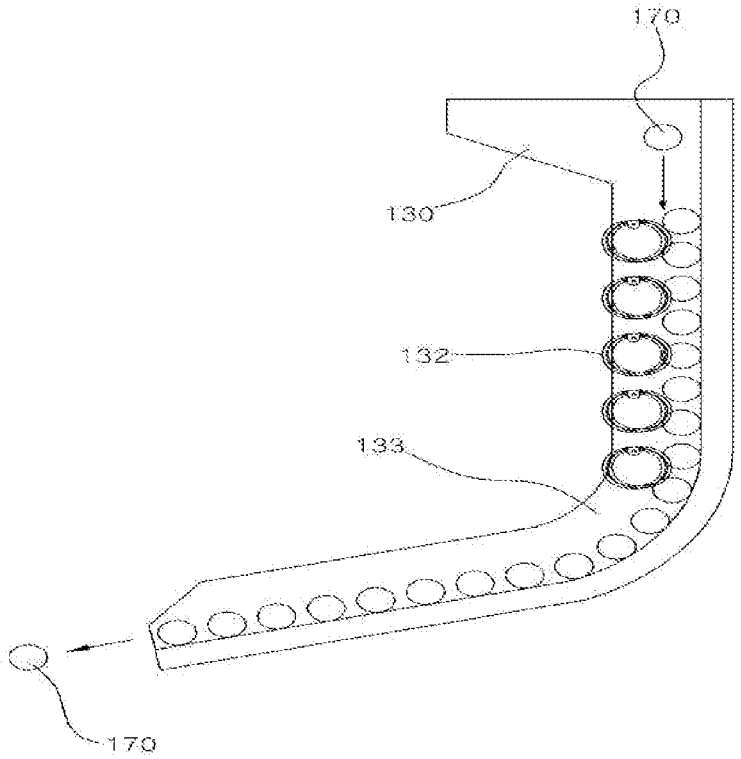
FIG. 6 is a view illustrating a speed reducer according to an embodiment of the present invention.

FIG. 6 is a view illustrating the hitting member guide 130 according to an embodiment of the present invention. The hitting member guide 130 will be explained in more detail with reference to FIG. 6.

Each hitting member guide 130 has a curved portion which is curved at a predetermined angle and formed at a height adjacent to the circular plate 110 so that a hitting member 170 that has been inserted into the hitting-member insert port and has dropped downwards can move along the hitting member passing channel 133 towards the targets 124.

That is, the curved portion curves from the vertical direction to the horizontal direction to allow the hitting member 170 that has been inserted and been being dropped to turn in the horizontal direction and roll on the circular plate 110. Here, the curved portion may be curved at an appropriate radius of curvature so that the moving direction of the hitting member 170, which is dropping, can be smoothly converted into the horizontal direction without the hitting member 170 being stopped.

In addition, each hitting member guide 130 includes a plurality of speed reducers 132 which reduce the speed at which the hitting member 170 that has been inserted into the hitting member guide 130 drops at.

Figure 7:
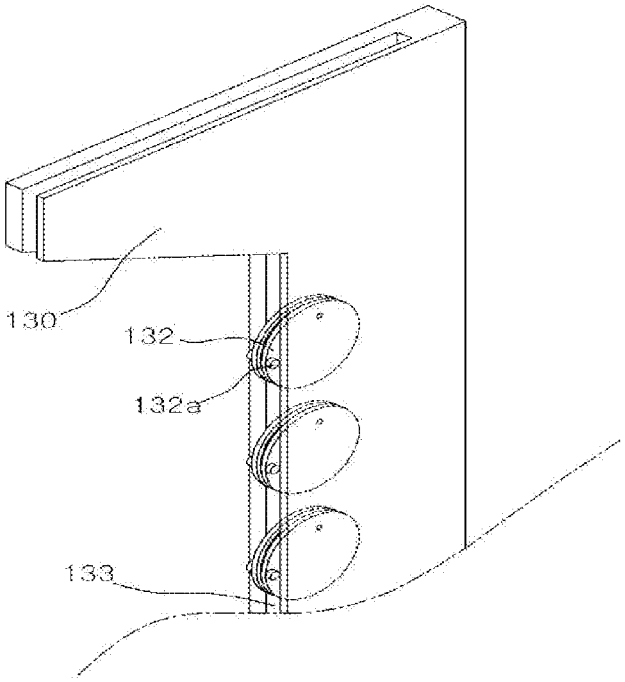
FIG. 7 is an enlarged view of a portion of the speed reducer of FIG. 6.

The speed reducer 132 will be explained in detail with reference to FIG. 7 that illustrates the construction of the speed reducer 132.

Each speed reducer 132 includes a small disk 132 which is installed in the hitting member guide 130 so as to be rotatable around a point on the circumference thereof or a center axis thereof. A cylindrical stop protrusion 132*a* is provided at a predetermined position on the disk 132 to prevent the disk 132 from rotating beyond a predetermined angle.

The speed reducer 132 may be made of a material, such as plastic or the like, that is lighter than that of the hitting member 170.

The presence of the stop protrusion 132*a* makes it possible to appropriately control the speed at which the hitting member 170 drops, thus enabling users to enjoy the game, as a means for relieving stress, with an easy mind without undesirably pausing to wait for the game.

As such, the hitting member guides 130 are provided on the central portion of the circular plate 110 towards the targets 124. Each hitting member guide 130 is configured such that: the hitting-member insert port is provided on the upper end thereof; the hitting member passing channel 133 communicates with the insert port and extends from the upper end of the hitting member guide 130 to the lower end thereof; a hitting-member outlet port is provided on the lower end of the hitting member guide 130 and extends a predetermined length towards the circumferential outer edge of the circular plate 110; and the hitting member 170 is inserted into the insert port and moves at a speed reduced by the speed reducers 132 along the hitting member guide 130 and is guided to hit one of the targets 124 of the target units 120 that are rotating along with the circular plate 110.

Furthermore, the thickness of the hitting member guide 130 may be slightly greater than that of the hitting member 170 so that the hitting member 170 inserted thereinto can uniformly move through it without being stuck or leaning.

In the embodiment of the present invention, although the hitting member guide 130 has been illustrated as being configured such that the curved portion is curved at a predetermined angle at a height adjacent to the circular plate 110, the shape of the hitting member guide 130 may be linear, or a vertical guide part of the hitting member guide 130 may be in an S shape.

The reason for forming the S-shaped vertical part is because the structure that can reduce the speed of the hitting member 170 can be simplified without the use of a separate speed reducer.

In detail, the hitting member guide 130 curves from the vertical guide part to a horizontal guide part so that a hitting member 170 that has been inserted into the hitting-member insert port and been dropping can turn towards the targets 124 and roll on the circular plate 110, wherein the vertical guide part has an S shape so that friction between the hitting member 170 that is dropping and the opposite sidewalls of the vertical guide part naturally reduce the speed of the hitting member 170.

Figure 8:
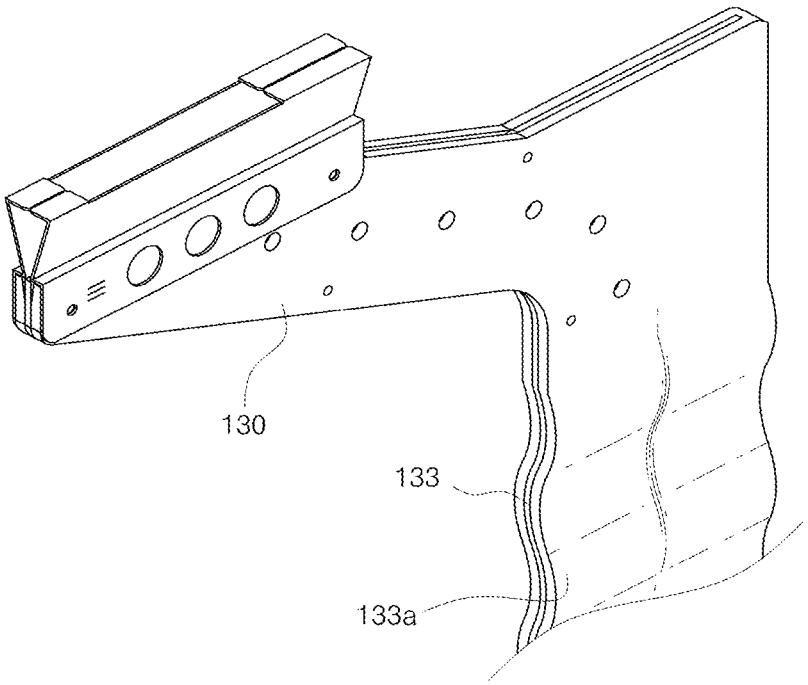
FIG. 8 is a view illustrating another type hitting member guide according to an embodiment of the present invention.

Referring to FIG. 8 illustrating the S-shaped vertical guide part of the hitting member guide 130, the vertical guide part is curved in an S shape with respect to the lateral direction. Thus, when the hitting member 170 is dropping along the hitting member passing channel 133, it collides with the sidewalls 133*a* of the hitting member guide 130, thus naturally reducing the speed at which the hitting member 170 is dropping.

Figure 9:
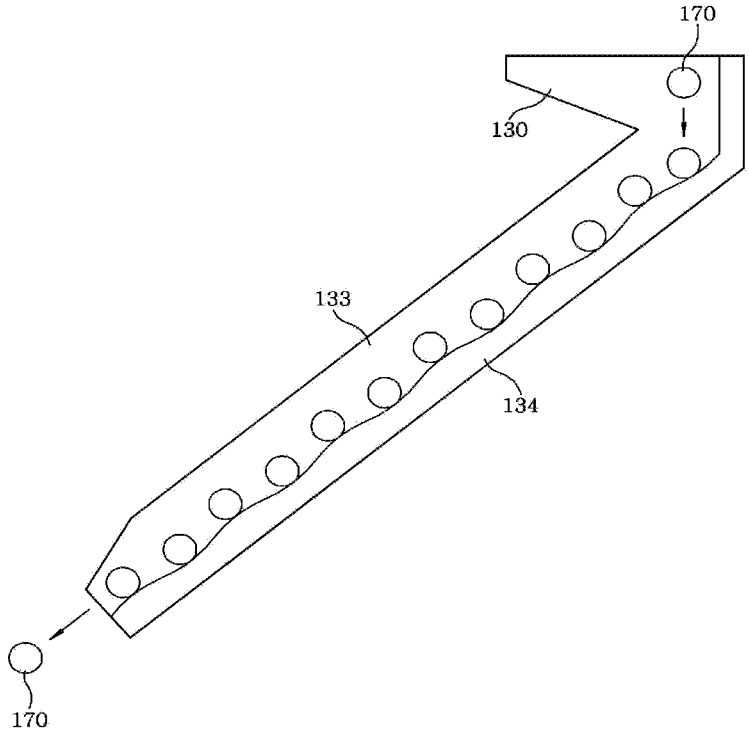
FIG. 9 is a view illustrating a further type hitting member guide according to an embodiment of the present invention.

FIG. 9 is a view showing another example of the shape of the hitting member guide 130. Referring to this drawing, the hitting member guide 130 has a linear shape that enables a hitting member 170 that has been inserted into the hitting-member insert port to move towards the targets 124. Further, a bottom surface 134 of the hitting member passing channel 133 along which the hitting member 170 rolls is wavy or uneven so that the speed of the hitting member 170 that has been inserted into the hitting member passing channel 133 and moved downwards can be reduced by the friction between the hitting member 170 and the bottom surface 134.

Each target standing unit 140 is disposed at a position following the corresponding target sensing unit 150, which will be explained later herein, with respect to the direction in which the circular plate 110 rotates. The target standing unit 140 functions to stand up the targets 124 that have been rotated downwards by hits of hitting members 170.

The target standing unit 140 is spaced apart from the circumferential outer edge of the circular plate 110 to a height lower than the targets 124, whereas the height thereof is gradually increased in the direction in which the circular plate 110 rotates.

Figure 12:
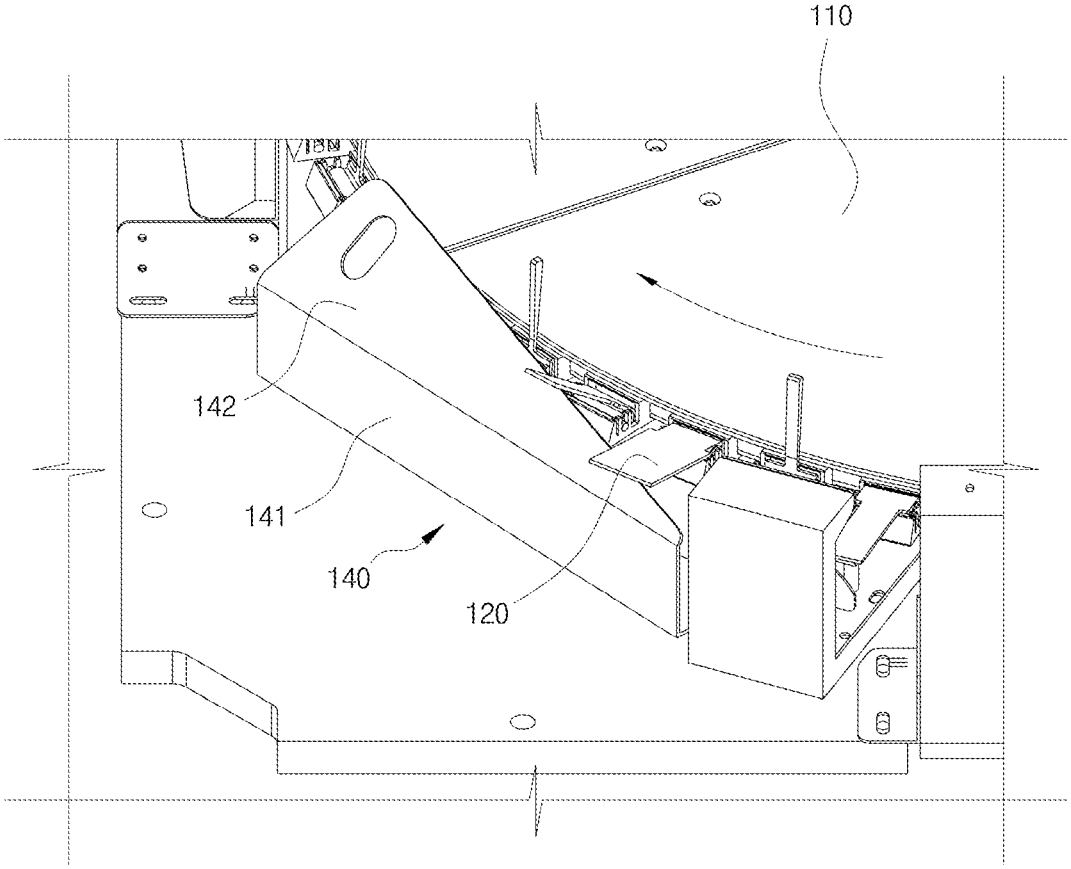
FIG. 12 is an enlarged view of a target standing unit according to an embodiment of the present invention.

The structure of the target standing unit 140 according to an embodiment of the present invention will be described in detail with reference to FIG. 12 showing an enlargement of the target standing unit 140. The target standing units 140 are installed in the hitting game machine 100 of an embodiment of the present invention, wherein each target standing unit 140 includes a base 141 and a target standing plate 142. The base 141 is disposed at a position spaced apart from the circumferential outer edge of the circular plate 110 to a height lower than the targets 124. The target standing plate 142 is provided on the base 141, and the height thereof is gradually increased in the direction in which the circular plate 110 rotates. Further, the target standing plate 142 is inclined at a predetermined angle towards the center of the circular plate 110. Thanks to the above-mentioned shape of the target standing unit 140, while the circular plate 110 is rotating, the target standing unit 140 can stand up the targets 124 that have fallen over.

The target sensing units 150 are provided at positions corresponding to the respective regions of the circular plate 110 in order to sense the targets 124 that have fallen over using the identification members provided on the identification-member attaching parts 122*c* of the target units 120 that have been fallen by hitting members 170. That is, among the target units 120, each target sensing unit 150 functions to sense the target 124 of a target unit 120 that has fallen over.

The target sensing unit 150 can be embodied such that it outputs a different sensing signal depending on the width of each target 124. In other words, the target sensing unit 150 can be configured such that it outputs the same sensing signal with regard to targets 124 having the same width.

With respect to the direction in which the circular plate 110 rotates, each target sensing unit 150 and the corresponding target standing unit 140 are arranged in such a way that the target sensing unit 150 is disposed ahead of the target standing unit 140 so that the operation of standing up the target 124 follows the operation of sensing the target 124.

The hitting member receivers 160 are provided at positions corresponding to the respective hitting member guides 130. The hitting member receivers 160 function to receive hitting members 170 that have hit targets 124 or passed them by.

That is, to prevent the hitting members 170 coming out of each hitting member guide 130 from rolling or falling out of the game machine, each hitting member receiver 160 is disposed at a position corresponding to the relative hitting member guide 130 and covers the corresponding region of the circular plate 110 in a wide manner.

Furthermore, an indication unit (not shown) may be installed above each hitting member guide 130. The indication unit functions to display a bonus point or gift corresponding to the target 124 that has been sensed by the target sensing unit 150.

A rotating unit (not shown) is provided under the rear surface of the circular plate 110 and rotates the circular plate 110 at a constant speed.

Depending on the width of the target 124 of each of the target units 120 having different shapes, a corresponding one of different points, gifts, tickets and medals is set for the target units 120. After the game has begun, the control unit 180 rotates the circular plate 110, and when an input hitting member 170 hits a target 124, the corresponding target sensing unit 150 senses the target 124 under the control of the control unit 180. Then, the control unit 180 instructs the indication unit 131 to display the corresponding one of the points, gifts, tickets and medals that is set for the sensed target 124.

Furthermore, the control unit 180 instructs the light source of the section pertaining to the sensed target 124 to flash on and off or may control the game machine such that when it is sensed that a preset target 124 has fallen over a predetermined number of times or more, a jackpot is provided or a bonus game is given.

The hitting game machine may further include a storage unit (not shown) which stores a list of prizes corresponding to the respective targets 124. In this case, when a target sensing unit 150 senses that a target 124 has been hit, the name of a prize corresponding to the target 124 may be picked up from the storage unit and displayed on the indication unit 131, or the corresponding prize may be directly provided, of course.

The operation of the hitting game machine having the above-mentioned construction will now be described.

Once the game begins, the circular plate 110 provided with the target units 120 rotates. A user successively inputs hitting members 170 into any one of the hitting member guides 130. The successively input hitting members 170 drop downwards while the speed reducers 132 reduce the speeds of the hitting members 170, and then move along the hitting member passing channel 133.

If at least one of the hitting members 170 that have passed through a hitting member guide 130 hits one of the targets 124 that are provided in the corresponding region of the circular plate 110 that is rotating, the corresponding target sensing unit 150 senses, using the corresponding identification member, the target 124 that has been fallen by the hitting member 170. The indication unit (not shown) which is disposed above the hitting member guide 130 displays a bonus point or gift corresponding to the sensed target 124.

Furthermore, as stated above, each region of the circular plate 110 is partitioned into sections, each of which has a fan shape that has the center of the circular plate 110 as its center and includes the corresponding target unit 120, and the light source is electrically connected to the rear surface of each section of the circular plate 110 so that each section can flash on and off. Thus, when the target 124 falls over, the corresponding light source flashes on and off, providing a visual effect.

Thereafter, the target standing unit 140 returns the target 124 that has fallen over to its original position, thus preparing the targets 124 for a game in a subsequent region.

As described above, a hitting game machine according to the embodiments of the present invention allows a user to input hitting members thereinto. Therefore, the user can more interestingly enjoy the game without the game being suspended.

The embodiments of the present invention can prevent rotation of a circular plate or fine impact such as vibrations or the like from easily felling targets of target units provided on the circular plate. Therefore, only fallen targets can be precisely sensed. Thus, the user can enjoy the game in a more reliable manner.

In addition, a hollow space is formed in a rotating shaft of each target to reduce the weight of the rotating shaft, thus making it possible to fell only a target that has been hit more precisely.

Furthermore, the shape of a hitting member guide can be modified into a variety of shapes. A separate speed reducer may not be used. In this case, the production cost of the hitting game machine can be reduced, and the structure thereof can be further simplified. Moreover, the user can select one of different shapes of guides and enjoy the game.

Because the embodiments of the present invention is configured such that only a hit target is precisely sensed, the user can enjoy the game in a correct manner.

Although the embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A hitting game machine allowing successive input of coins, the hitting game machine being operated in such a way as to sense a target rotated by a hit of a hitting member and to process a game, the hitting machine comprising:

a plurality of target units, each target unit comprising:

a hinge bracket, the hinge bracket including a hinge coupling depression; and a target, the target comprising:

a rotating shaft;

an eccentric shaft formed at a position eccentric from a center of the rotating shaft, the rotating shaft rotating on the eccentric shaft the eccentric shaft inserted into and rotatably supported in the hinge coupling depression, wherein a protrusion is provided on a surface of the eccentric shaft so that when the rotating shaft rotates, the protrusion selectively makes contact with a side surface of the hinge coupling depression, and generates a frictional force depending on an angle at which the rotating shaft rotates; and a hit surface to be hit by the hitting member, the hit surface integrally rotating with the rotating shaft and having a plate shape, a longitudinal section of which is a linear shape or a shape that is reduced in width from an upper end thereof to a lower end; and a circular plate to which the hinge bracket of each target unit is coupled, wherein each target is coupled to the circular plate such that even when the target coupled to the circular plate is being rotated or has been rotated by a hit of the hitting member, another subsequent hitting member is allowed to pass over the same target, wherein the hinge bracket supports the hit surface of the target to allow the target to lean towards the center of the circular plate.

2. The hitting game machine as set forth in claim 1, wherein the eccentric shaft comprises first and second eccentric shafts provided on the respective opposite ends of the rotating shaft, and a hollow space is formed in each of the opposite ends of the rotating shaft at a position other than the eccentric shaft, the hollow space having a predetermined length.

3. The hitting game machine as set forth in claim 1, wherein the circular plate is partitioned into at least one region and is operated by a drive unit.

4. The hitting game machine as set forth in claim 1, wherein the hinge bracket comprises:

a base plate;

a first over-rotation-preventing stopper provided on the base plate to support the hit surface of the target to allow the target to lean towards the center of the circular plate;

wherein the hinge coupling depression is formed on the base plate at a position spaced apart from the first over-rotation-preventing stopper by a predetermined distance so that the eccentric shaft of the target is inserted into and supported in the hinge coupling depression; and a second over-rotation-preventing stopper provided on the base plate at a position adjacent to the hinge coupling depression.

5. The hitting game machine as set forth in claim 4, wherein there is at least a space defined between the lower portion of a rolling surface of the hitting member and an upper surface of the rotating shaft when the hitting member comes into contact with the first and second over-rotation-preventing stoppers, wherein the hinge coupling depression is formed to a depth such that the rotating shaft is disposed at a sufficiently low position to allow the hitting members that are rolling to pass over the rotating shaft, and wherein a width between the first over-rotation-preventing stopper and the second over-rotation-preventing stopper is determined such that the rolling surface of the hitting member is prevented from touching any portion of the rotating shaft.

6. The hitting game machine as set forth in claim 3, further comprising:

a hitting member guide provided at a predetermined position on each of the at least one region of the circular plate and oriented towards the targets, with a hitting-member insert port provided on one end of the hitting member guide, the hitting member guide guiding the hitting member input into the hitting-member insert port to move towards the targets and to hit one of the targets;

a target sensing unit provided in each of the at least one region of the circular plate, the target sensing unit sensing the target that has been fallen by the hitting member;

an indication unit provided at a predetermined position of the hitting member guide, the indication unit indicating at least one of a bonus point, a gift, a ticket and a medal that corresponds to the target sensed by the target sensing unit; and a target standing unit disposed at a position coming next after the target sensing unit with respect to a direction in which the circular plate rotates, the target standing unit returning the target that has rotated by the hit of the hitting member to an original position thereof.

7. The hitting game machine as set forth in claim 6, wherein the hitting member guide is curved from a vertical direction to a horizontal direction to allow the hitting member that has been inserted and is dropped to turn in the horizontal direction and roll on the circular plate towards the targets, the hitting member guide further comprising:

a speed reducer reducing a speed at which the hitting member that has been input is dropping, the speed reducer comprising a disk installed in the hitting member guide so as to be rotatable around a point on a circumference thereof or a center axis thereof and a cylindrical stop protrusion provided at a predetermined position on the disk to prevent the disk from rotating beyond a predetermined angle.

8. The hitting game machine as set forth in claim 6, wherein the hitting member guide is curved from a vertical guide part to a horizontal guide part so that the hitting member that has been input into the hitting-member insert port and has been dropping turns in a direction toward the targets and rolls on the circular plate, wherein the vertical guide part has an S shape.

9. The hitting game machine as set forth in claim 6, wherein the hitting member guide has a linear shape that allows the hitting member that has been input into the hitting-member insert port to move towards the targets, and a bottom surface of the hitting member guide along which the hitting member rolls is wavy or uneven so that a speed at which the hitting member moves downwards is reduced.

10. The hitting game machine as set forth in claim 6, wherein each region of the circular plate is partitioned into sections, each of the sections having a fan shape that has a center of the circular plate as a center thereof and having one of the targets.

11. The hitting game machine as set forth in claim 6, wherein the target standing unit is disposed at a position spaced apart from a circumferential outer edge of the circular plate to a height lower than the targets, wherein a height of the target standing unit is gradually increased in the direction in which the circular plate rotates, and an upper end of the target standing unit is inclined at a predetermined angle towards the center of the circular plate.

12. The hitting game machine as set forth in claim 6, wherein heights of the hit surfaces of the targets are equal to each other, but widths thereof are different from each other, wherein when one of the targets rotates down, a corresponding one of different points, gifts, tickets and medals is indicated.

13. The hitting game machine as set forth in claim 6, further comprising:

a control unit providing a jackpot or a bonus game when a preset one of the targets has fallen over a predetermined number of times or more.

* * * * *